US008414148B2

(12) United States Patent
Kuo

(10) Patent No.: US 8,414,148 B2
(45) Date of Patent: Apr. 9, 2013

(54) LAMP CUP AND LIGHTING APPARATUS COMPRISING THE SAME

(75) Inventor: Hung-Pin Kuo, Taichung (TW)

(73) Assignee: B&M Optics Co., Ltd., Taichung (TW)

( * ) Notice: Subject to any disclaimer, the term of this patent is extended or adjusted under 35 U.S.C. 154(b) by 12 days.

(21) Appl. No.: 13/287,613

(22) Filed: Nov. 2, 2011

(65) Prior Publication Data

US 2012/0113651 A1 May 10, 2012

(30) Foreign Application Priority Data

Nov. 5, 2010 (TW) ..... 99138208 A

(51) Int. Cl.
*F21V 33/00* (2006.01)

(52) U.S. Cl. ..... 362/245; 362/247; 362/249.02; 362/311.02

(58) Field of Classification Search ..... 362/311.02, 362/249.02, 241, 245, 247
See application file for complete search history.

(56) References Cited

U.S. PATENT DOCUMENTS

| | | | | |
|---|---|---|---|---|
| 7,410,273 | B2 | 8/2008 | Lin | |
| 7,922,366 | B2 * | 4/2011 | Li | 362/304 |
| 2008/0298062 | A1 * | 12/2008 | Wang | 362/247 |
| 2009/0237943 | A1 * | 9/2009 | Schmidt et al. | 362/311.02 |

FOREIGN PATENT DOCUMENTS

| | | |
|---|---|---|
| TW | 342075 | 10/1998 |

* cited by examiner

*Primary Examiner* — Laura Tso
(74) *Attorney, Agent, or Firm* — Muncy, Geissler, Olds & Lowe, PLLC

(57) ABSTRACT

A lamp cup, adapted to be coupled with a luminous module, includes a cup body and a lens. The cup body includes a top wall and an annular sidewall extending downwardly from a periphery of the top wall. The top wall has a top surface to be joined with a circuit board of the luminous module and defines an aperture from top to bottom therein at a position corresponding to a light emitting component of the luminous module. The lens is securely mounted in the aperture of the top wall of the cup body to be aligned with the light emitting component.

16 Claims, 4 Drawing Sheets

LAMP CUP AND LIGHTING APPARATUS COMPRISING THE SAME

BACKGROUND OF INVENTION

1. Field of Invention

This invention relates generally to a lamp cup adapted to be coupled with a lighting module, and more particularly to a lamp cup with a lens designed for a light emitting component of the lighting module.

2. Related Prior Art

As shown in U.S. Pat. No. 7,410,273, a conventional lamp cup is included in a LED lamp assembly. The LED lamp assembly further includes an LED lamp and a lamp holder configured to fasten the LED lamp onto the lamp cup. It is noted that the lamp cup is merely a reflection cup for reflecting light from the LED lamp. The LED lamp itself includes a base, an LED device and a lens mounted on the base to enclose the LED device. The LED device includes a circuit board and at least one light emitting diode mounted on the circuit board. In this way, light beam generated by the light emitting diode is firstly directed by the lens into a desired pattern and then reflected by the lamp cup to a predetermined area.

SUMMARY OF INVENTION

It is a primary object of the invention to provide a different lamp cup which makes a lighting apparatus easy to manufacture.

In the preferred embodiment, this lighting apparatus includes the lamp cup and a luminous module. The luminous module includes a circuit board and a light emitting component mounted on bottom of the circuit board. The lamp cup includes a cup body and a lens fastened on the cup body.

Specifically, the cup body of the lamp cup includes a top wall and an annular sidewall extending downwardly from a periphery of the top wall. The top wall has a top surface joined with the circuit board and an aperture defined from top to bottom at a position corresponding to the light emitting component. The lens is securely mounted in the aperture of the top wall of the cup body and aligned with the light emitting component. As such, the lens itself can be easily fastened on the cup body to form a part of the lamp cup, rather than a part of the luminous module. Thus, the light emitting component of the luminous module, without being pre-enclosed with a lens as taught by the prior art, can be directly used for the assembly of the lighting apparatus, which makes the assembly much easier.

BRIEF DESCRIPTION OF DRAWINGS

The invention will be more clearly understood after referring to the following detailed description read in conjunction with the drawings wherein.

DETAILED DESCRIPTION OF PREFERRED EMBODIMENT

Figure 1:
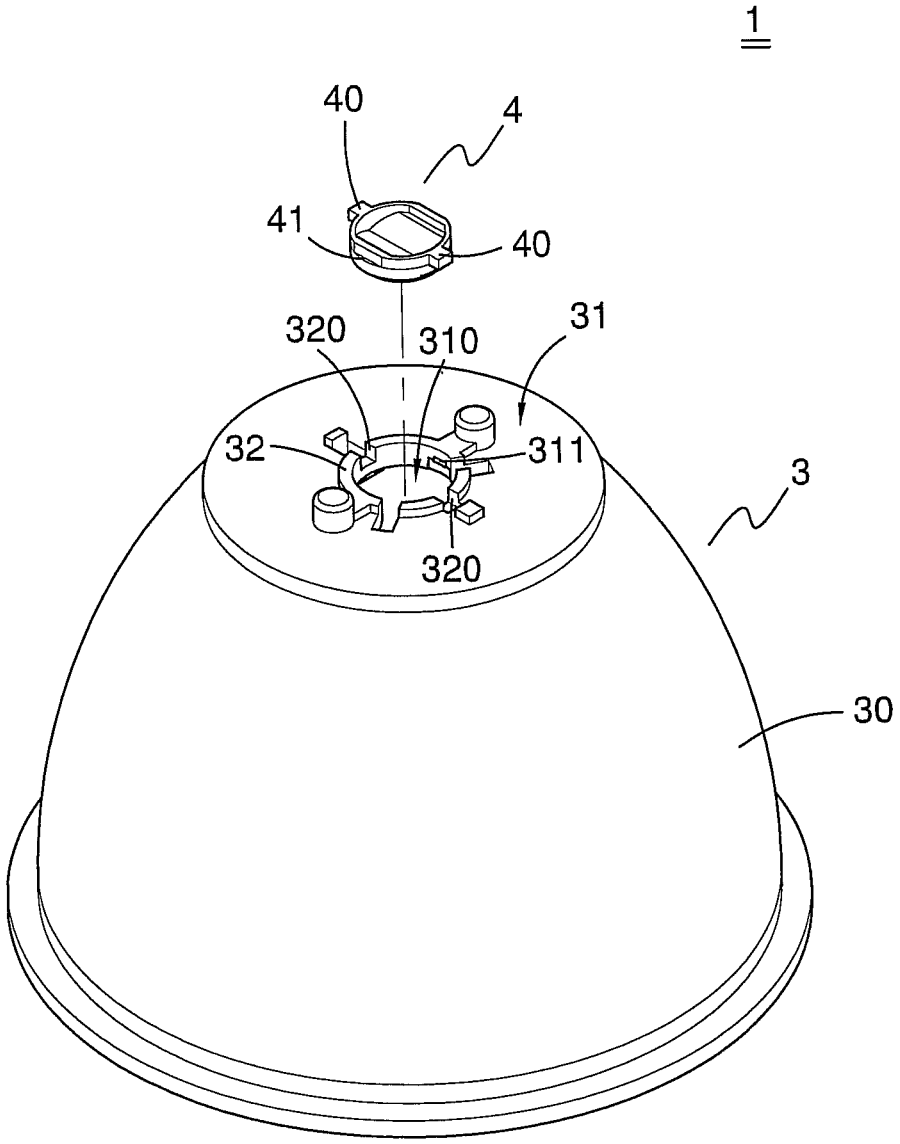
FIG. 1 is an exploded perspective view of a lamp cup according to the preferred embodiment of this invention.
Figure 2:
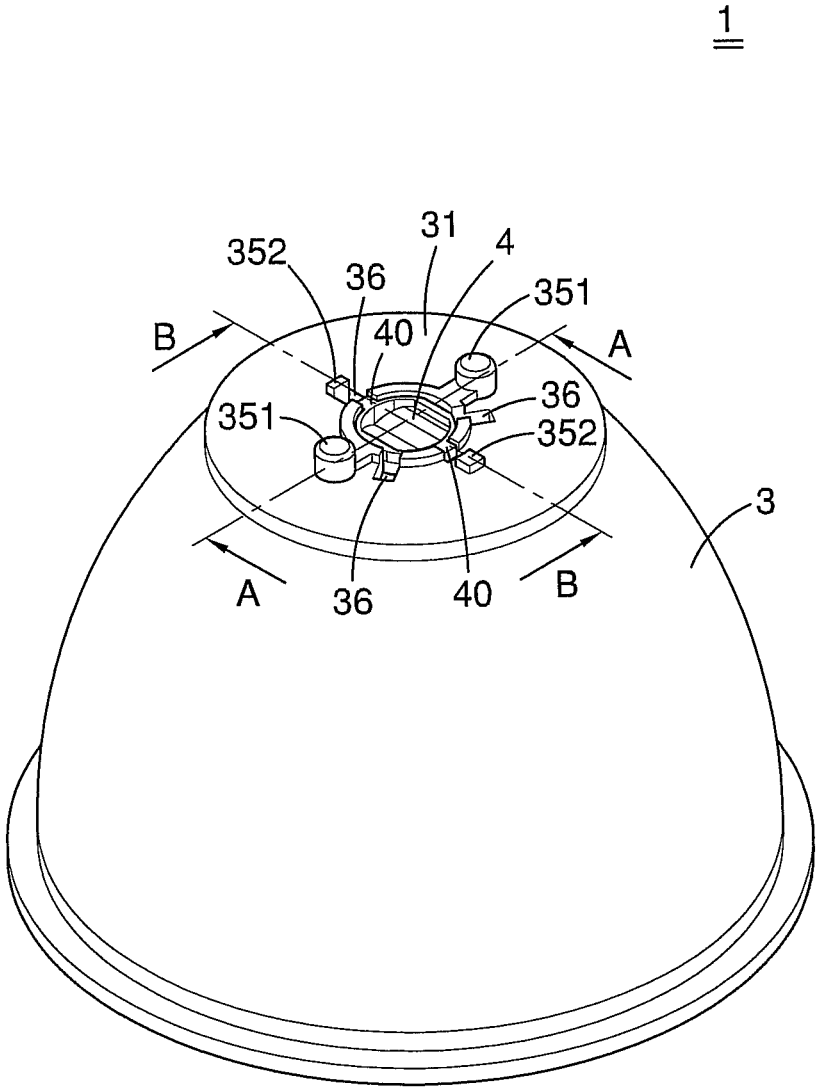
FIG. 2 is a perspective view of the lamp cup of FIG. 1.
Figure 3:
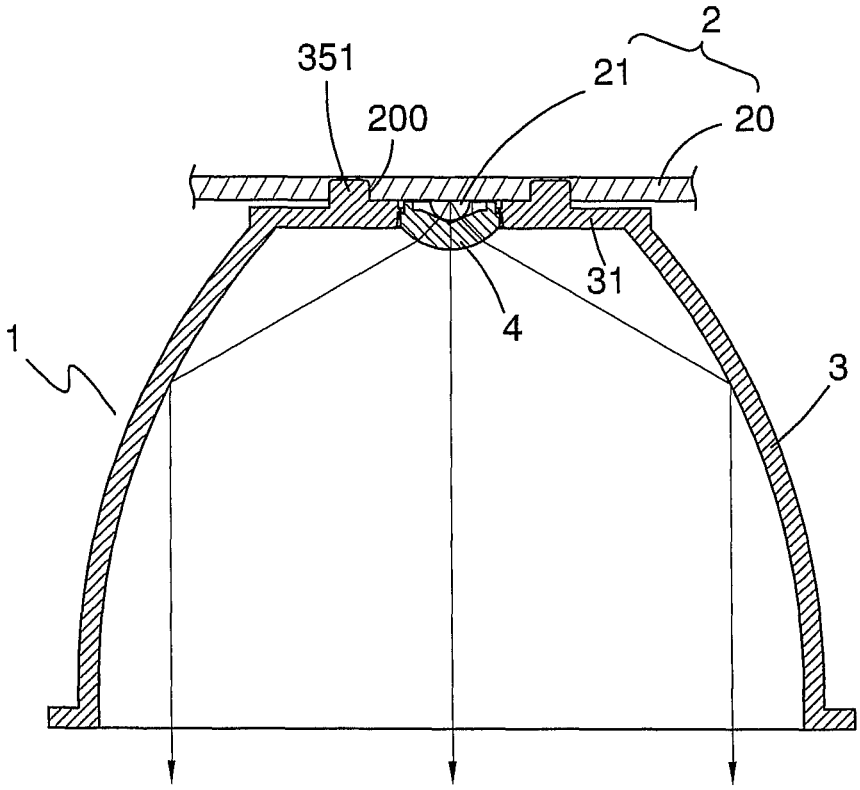
FIG. 3 is a cross sectional view of the lamp cup connected with a luminous module.

With reference to FIGS. 1 and 2, a lamp cup 1 in accordance with the preferred embodiment of the present invention includes a cup body 3 and a lens 4 securely disposed on the cup body 3. The lamp cup 1 is adapted to be coupled with a luminous module 2, as shown in FIG. 3, which generally includes a circuit board 20 and a light emitting component 21, such as a LED package component.

As shown in FIG. 1, the cup body 3 includes a top wall 31 and an annular sidewall 30 extending downwardly from a periphery of the top wall 31. The cup body 3 is coated with a reflective substance on its inner surface to form a reflector. Preferably, the top wall 31 and the annular sidewall 30 are formed in one piece. In addition, the top wall 31 of the cup body 3 defines an aperture 310 from top to bottom at a position corresponding to the light emitting component 21 which is mounted on a bottom surface of the circuit board 20 as shown in FIG. 3. The lens 4 is securely mounted in the aperture 310 of the top wall 31 of the cup body 3 to be aligned with the light emitting component 21. In this manner, when the lamp cup 1 is coupled with the luminous module 2, as shown in FIG. 3, the lens 4 of the lamp cup 1 is located right under the light emitting component 21 of the luminous module 2 to direct the light beam generated from the light emitting component 21 into a desired optical pattern. Then, some of the light beam coming out from the lens may go further to hit an inner reflective wall surface of the cup body 3 and be reflected to a target area.

Figure 4:
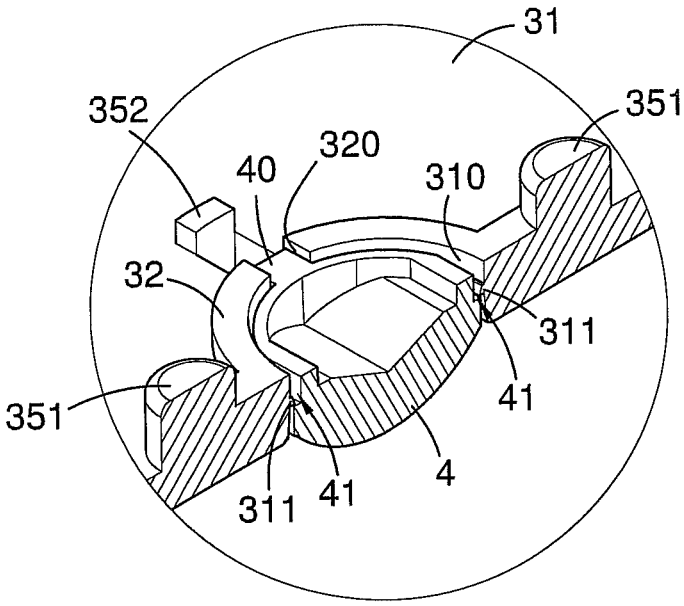
FIG. 4 is an enlarged view showing a cut-way portion taken from line A-A of FIG. 3.

To assemble the lens 4 and the cup body 3 together, the lens 4 should be fed, from the top side of the top wall 31, into the aperture 310. Specifically, as shown in FIG. 1, the lens 4 includes two upper lugs 40 at opposite sides thereof and two notches 41 defined in two other opposite sides thereof. Relative to the notches 41 of the lens 4, the top wall 31 of the cup body 3 is formed with two opposing projections 311 extending from an inner wall surface of the aperture 310 of the top wall 31. Each of the projections 311 has an inclined guiding top surface and a flat bottom surface. When the lens 4 is fed into the aperture 310 of the cup body 3, the inclined top surfaces of the projections 311 guides the lens 4 to pass over the projections 311 and be lodged inside the aperture 310 of the top wall 31 of the cup body 3, as shown seen in FIG. 4. At this time, the lens 4 is fastened on the cup body 3 and is unable to move downward or upward anymore by itself due to the lugs 40 of the lens 4 pressing against the top surface of the top wall 31 and the projections 311 of the top wall 31 being trapped in the notches 41 of the lens 4.

Referring back to FIG. 1, the top wall 31 of the cup body 3 further includes a rotation limiting arrangement for limiting rotation of the lens 4 with respect to the cup body 3. In this embodiment, the rotation limiting arrangement is an annular block 32 in which a pair of opposing grooves 320 are defined. The annular block 32 is located around the aperture 310 of the top wall 31; and when the lens 4 is lodged in the aperture 310 of the top wall 31, the lugs 40 of the lens 4 are received in the grooves 320 of the annular block 32, as depicted in FIG. 2. Since the lugs 40 are caught in the grooves 320 of the annular block 32, the lens 4 is not allowed to be rotated with respect to the cup body 3. In another example, the rotation limiting arrangement may exclude the annular block 32 but define at opposite sides of the aperture 310 of the top wall 3 a pair of opposing grooves in a flat top surface of the top wall 31.

Figure 5:
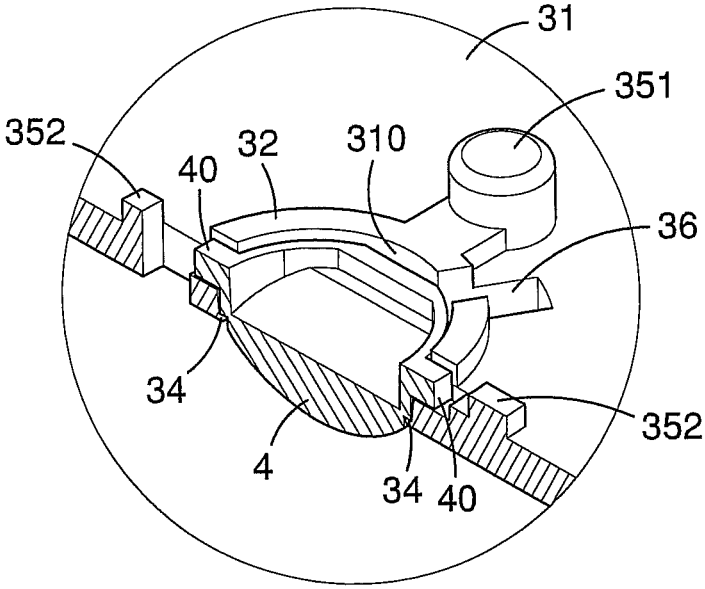
FIG. 5 is a view similar to FIG. 4, showing a cut-way portion taken from line B-B of FIG. 3.

As best seen in FIG. 5, the top wall 31 of the cup body 3 further includes another two opposing projections 34 extending from the inner wall surface of the aperture 310 of the top wall 31 and located at a position lower than that of the first two opposing projections 311. The second two opposing projections 34 abut against a peripheral of the lens 4 to ensure that the lens 4 would not fall off the cup body 3 from the aperture 310. Alternatively, in another example, the cup body 3 and the lens 4 may be formed in one piece via plastic injection molding.

Referring to FIGS. 2 and 3, the top wall 31 of the cup body 3 further includes a pair of positioning posts 351 each received in a positioning hole 200 of the circuit board 20 of the luminous module 2. Moreover, the top wall 31 of the cup body 3 includes a pair of supporting posts 352 which has the same height with the annular block 32. Lodge of the positioning posts 351 of the top wall 31 in the positioning holes 200 of the circuit board 20 ensures that the light emitting component 21 of the luminous module 2 is aligned with the lens 4 of the lamp cup 1. The supporting posts 352 and the annular block 32 together hold the circuit board 20 in a level. Once the luminous module 2 and the lamp cup 1 are in position, screws (not shown) or the like may be used to lock them together via holes 36 defined in the top wall 31 of the cup body 3.

The foregoing description is for purposes of illustration only and is not intended to limit the scope of the protection accorded this invention. The scope of protection is to be measured by the following claims, which should be interpreted as broadly as the inventive contribution permits.

The invention claimed is:

1. A lamp cup adapted to be coupled with a luminous module that includes a circuit board and a light emitting component mounted on bottom of the circuit board, the lamp cup comprising:

a cup body including a top wall and an annular sidewall extending downwardly from a periphery of the top wall; the top wall having a top surface to be joined with the circuit board and an aperture defined from top to bottom at a position corresponding to the light emitting component; and a lens securely disposed in the aperture of the top wall of the cup body to be aligned with the light emitting component.

2. The lamp cup of claim 1, wherein the top wall of the cup body further includes two opposing projections extending from an inner wall surface of the aperture of the top wall; the lens includes two upper lugs at opposite sides thereof and two notches defined in two other opposite sides thereof; and the lens is fastened on the cup body as a result of the lugs pressing against the top surface of the top wall of the cup body and the projections of the top wall of the cup body being trapped in the notches of the lens.

3. The lamp cup of claim 2, wherein the top wall of the cup body further includes a rotation limiting arrangement for limiting rotation of the lens with respect to the cup body.

4. The lamp cup of claim 3, wherein the rotation limiting arrangement includes an annular block around the aperture of the top wall; the annular block defines a pair of opposing grooves in which the lugs of the lens are rested.

5. The lamp cup of claim 2, wherein the top wall of the cup body further includes another two opposing projections extending from the inner wall surface of the aperture of the top wall and located at a position lower than that of the first two opposing projections for holding the lens.

6. The lamp cup of claim 1, wherein the top wall of the cup body further includes at least one positioning post thereon to be received in a positioning hole of the circuit board.

7. The lamp cup of claim 3, wherein the top wall of the cup body further includes a pair of positioning posts and a pair of supporting posts thereon; the positioning posts are constructed to be inserted in positioning holes of the circuit board; and the supporting posts and the annular block have the same height for holding the circuit board.

8. The lamp cup of claim 7, wherein the top wall of the cup body further defines a plurality of holes from top to bottom therein for screws.

9. A lighting apparatus comprising:

a luminous module including a circuit board and a light emitting component mounted on bottom of the circuit board;

a cup body including a top wall and an annular sidewall extending downwardly from a periphery of the top wall; the top wall having a top surface joined with the circuit board and an aperture defined from top to bottom at a position corresponding to the light emitting component; and a lens securely mounted in the aperture of the top wall of the cup body and aligned with the light emitting component.

10. The lighting apparatus of claim 9, wherein the top wall of the cup body further includes two opposing projections extending from an inner wall surface of the aperture of the top wall; the lens includes two upper lugs at opposite sides thereof and two notches defined in two other opposite sides thereof; and the lens is fastened on the cup body as a result of the lugs pressing against the top surface of the top wall of the cup body and the projections of the top wall of the cup body being trapped in the notches of the lens.

11. The lighting apparatus of claim 10, wherein the top wall of the cup body further includes a rotation limiting arrangement for limiting rotation of the lens with respect to the cup body.

12. The lighting apparatus of claim 11, wherein the rotation limiting arrangement includes an annular block around the aperture of the top wall; the annular block defines a pair of opposing grooves in which the lugs of the lens are rested.

13. The lighting apparatus of claim 10, wherein the top wall of the cup body further includes another two opposing projections extending from the inner wall surface of the aperture of the top wall and located at a position lower than that of the first two opposing projections for holding the lens.

14. The lighting apparatus of claim 9, wherein the top wall of the cup body further includes at least one positioning post and received in a positioning hole that is defined in a bottom surface of the circuit board.

15. The lighting apparatus of claim 12, wherein the top wall of the cup body further includes a pair of positioning posts and a pair of supporting posts arranged around the aperture of the top wall; the positioning posts are received in positioning holes that are defined in a bottom surface of the circuit board; and the supporting posts and the annular block have the same height and abut against the bottom surface of the circuit board.

16. The lighting apparatus of claim 15, wherein the top wall of the cup body further defines a plurality of holes from top to bottom therein for screws.

* * * * *